United States Patent [19]

Voss

[11] Patent Number: 4,544,035

[45] Date of Patent: Oct. 1, 1985

[54] APPARATUS AND METHOD FOR USE IN DETONATING A PIPE-CONVEYED PERFORATING GUN

[76] Inventor: Charles V. Voss, 3800 Plateau Pl., Casper, Wyo. 82604

[21] Appl. No.: 580,069

[22] Filed: Feb. 14, 1984

[51] Int. Cl.[4] ..... E21B 43/118.5

[52] U.S. Cl. ..... 166/299; 166/55.1; 166/63; 166/65.1; 166/297

[58] Field of Search ..... 166/299, 297, 55, 55.1, 166/65 R, 63; 175/5.52, 5.54, 5.56; 102/200

[56] References Cited

U.S. PATENT DOCUMENTS

| | | | |
|---|---|---|---|
| 2,092,337 | 9/1937 | Spencer | 166/55.1 |
| 2,411,339 | 12/1942 | Rolfes et al. | 102/28 |
| 2,620,029 | 12/1952 | Turechek et al. | 166/55.1 |
| 2,924,173 | 6/1956 | Robertson | 102/20 |
| 2,986,214 | 5/1961 | Wiseman, Jr. et al. | 166/297 |
| 3,421,440 | 1/1969 | Snyder | 102/70.2 |
| 3,572,245 | 3/1971 | Grayson | 102/20 |
| 3,666,030 | 5/1972 | Bohn et al. | 166/55.1 |
| 4,007,796 | 2/1977 | Boop | 175/4.55 |
| 4,113,016 | 9/1978 | Trott | 166/297 |
| 4,246,845 | 1/1981 | Winton et al. | 102/206 |
| 4,273,051 | 6/1981 | Stratton | 102/202.2 |

FOREIGN PATENT DOCUMENTS 1394457 5/1975 United Kingdom ..... 166/299

OTHER PUBLICATIONS

"Induction Firing System For Hero-proof Launch Initiation of Ordnance From Mortars, Guns, Rocket Launchers, etc." by Warnock, 6/1973.

*Primary Examiner*—James A. Leppink
*Assistant Examiner*—Hoang C. Dang
*Attorney, Agent, or Firm*—Sheridan, Ross & McIntosh

[57] ABSTRACT

An apparatus is provided for use in detonating explosives positioned in a well. The apparatus includes a first coupling member and a second coupling member. The first coupling member is joined to a housing containing explosives. Both the first coupling member and the second coupling member have conductor wire joined thereto. The first coupling member is hollow and of a size to matingly receive the second coupling member therein. Each coupling member is separately located near a desired location in the well. Then the coupling members are matingly joined together and electrical energy is delivered to the conductor wire of the second coupling member. By means of inductive coupling, electrical energy is provided to the conductor wire of the first coupling member. The electrical energy is used to detonate the explosives to produce a hole in a well casing at the desired location.

12 Claims, 4 Drawing Figures

APPARATUS AND METHOD FOR USE IN DETONATING A PIPE-CONVEYED PERFORATING GUN

FIELD OF THE INVENTION

The present invention relates to an apparatus for detonating explosives in order to provide an opening in a well casing and, in particular, to an apparatus having a pair of coupling members with conductor wire which functions to provide inductively coupled electrical energy to a perforating gun.

BACKGROUND INFORMATION

In providing an opening in a well casing located in a well, it is common practice to use explosives. Explosives are housed in a carrier or "gun" which is positioned at a desired location in the well. After proper positioning, the explosives are detonated by some triggering mechanism. The detonated explosives create a hole in the well casing so that fluid can be received therethrough into the casing. Typically, oil is expected to flow into the casing through the created hole.

A class of well casing perforating devices used in a well includes a pipe-conveyed perforating gun. In this class, the perforating gun is a cylindrical steel tube that houses explosives. The gun is joined to pieces of pipe or tubing which are lowered into the well bore until the gun is positioned in the casing about where the hole is to be formed. This approximate location can be determined by monitoring the number of pipe lowered into the well and knowing the length of each pipe. To determine more precisely the desired location for detonation, a gamma ray or neutron tool may be employed to provide a correlation log. This tool senses the natural background radiation of the formation adjacent to the tool. Knowing this background information enables the operator to determine where the casing perforation is to be made and the pipe, together with the gun, can be vertically moved to this desired location.

In previously devised systems, after the gun was properly positioned, a heavy metal object, called a "drop bar" was placed in the bore of the pipe located at the top of the well and dropped. The bar was expected to travel through the pipe, contact a firing piece or sub containing cartridges, which would explode and trigger the explosives. This approach used in connection with a pipe-conveyed gun has various drawbacks. First, the gun is placed in a firing state on the surface before lowering the same into the well. As as a consequence, unwanted firing of the gun can occur. That is, an object accidentally contacting the firing sub may set off the explosives. Second, the drop bar travels in an essentially uncontrolled manner down the pipe. As a result of the thousands of pounds of pipe joined together, the path of travel may not be straight thereby causing the drop bar to become lodged in the pipe. The gun would then not be triggered. Since the operator would then have to remove the assembly from the well to corect the problem with the undetonated explosives, in the process of removing the pipe from the well, the bar may be dislodged and then strike the gun and detonate the explosives at a location remote from the desired location in the well casing.

The present invention overcomes these problems in a pipe-conveyed gun through the use of coupling members which remain separated until the detonation of the explosives is desired. Unlike the previously known system, the gun is not in a firing condition when it is lowered into the well because the coupling members are separated and not in a position to provide electrical energy to a blasting cap used to detonate the explosives. Additionally, there is no concern that undetonated explosives are being pulled back to the top of the well in a firing state since the coupling members would be separated resulting in a non-firing state of the gun.

STATEMENT RELATING TO PRIOR ART

Under the provisions of 37 C.F.R. 1.97–1.99, the following patents are discussed:

U.S. Pat. No. 4,273,051 to Stratton discloses an electrically-ignited load such as a fuse head, being connected to the secondary winding of a transformer. The secondary winding is magnetically linked to a primary winding through a magnetic circuit. The structure selectively passes electrical ignition energy to the load but only in response to input electrical energy having predetermined magnitude and frequency characteristics.

U.S. Pat. No. 2,411,339 to Rolfes et al. discloses a firing means for an electrically-actuated blasting detonator in which a magnetic core is used in the detonator. Leads of the blasting circuit are wound respectively around the opposite halves of the magnetic core, one lead being wound as a right-hand helix and the other lead being wound as a left-hand helix.

U.S. Pat. No. 2,924,173 to Robertson discloses a well perforator firing means employing an arming element having a mercury switch contained therein. The firing circuit will not be armed unless the mercury switch is tilted to the preselected orientation.

U.S. Pat. No. 4,007,796 to Boop discloses an apparatus and technique for disarming and arming an electrical fireable explosive well tool. A switch in the gun electrically isolates an associated blasting cap and short circuits the terminals of the cap until the cap and perforating element are armed.

U.S. Pat. No. 3,572,245 to Grayson relates to an apparatus for clearing away debris tending to clog flow perforations in a well casing by selective detonation of explosive cords.

U.S. Pat. No. 4,246,845 to Winton et al. discloses an AC initiating system for a detonator. Three AC transmission signals are interlocked for safety by frequency, phase, and power discrimination.

U.S. Pat. No. 3,421,440 to Synder discloses an electromagnetic actuated detonating system employing radio frequency waves.

DISCLOSURE OF THE INVENTION

In accordance with the present invention, an apparatus is provided which includes a pair of coupling members and conductor wire joined to each of the two coupling members. The conductor wire joined to a first or female coupling member is, in one embodiment, electrically connected to a carrier or gun housing explosives. Conductor wire joined to a second or male coupling member is electrically connected to a source of electrical energy located at the top of a well. The two coupling members are separately positioned in the well and then matingly joined together at or near the location at which a well casing perforation is to be made. After being joined together in the well, electrical energy is supplied to the conductor wire of the male coupling member and is inductively coupled to the conductor wire of the female coupling member. This electrical energy is used to detonate the explosives in the carrier to provide a hole in a well casing at the desired location.

More particularly, a female coupling member is connected at one end to a perforating gun housing explosives and at another end to a sleeve, a packer, and pipe, which are lowered into a well. The female coupling member includes a hollow coil form or body and a hollow female housing. Conductor wire is wrapped around the coil form and the coil form is positioned within the hollow portion of the female housing. The conductor wire is electrically connected to a blasting cap, which is used to detonate the explosives. A male member is also provided, which includes a coil form or body and a hollow male housing. Conductor wire is wrapped around this coil form and the coil form is positioned within the hollow portion of the male housing. This male conductor wire is electrically connected to a center conductor, which runs from the male conductor wire to the top of the well. The center conductor communicates with a source of electrical energy.

The female coupling member is lowered into a well having a well casing using pipe. As the pipe is lowered into the well, the position of the perforating gun is monitored so that it can be determined when the perforating gun is at a desired location in the well. The male coupling member is separately lowered into the bore of the pipe using a winch and wire line including the center conductor. After the female coupling member is in the desired position, the male coupling member is lowered into and received by the hollow portion of the female coil form. Upon mating engagement between the two coupling members, the perforating gun can be triggered. This is accomplished by providing electrical alternating or pulsating current using the source of electrical energy to the primary coil or conductor wire of the male coupling member. The electrical current is inductively coupled to the secondary coil or conductor wire of the female coupling member. Since the secondary coil is in electrical communication with a blasting cap, the current triggers the blasting cap, which causes detonation of the explosives and results in a hole formed in the well casing.

Based on the foregoing, a number of advantages of the present invention are readily discerned. A detonating apparatus is provided for connection to pipe for placement at a desired location in a well. The apparatus includes two major components which are kept apart until it is desired to detonate the explosives. As a result, accidental or inadvertent explosions are virtually eliminated. Relatedly, the detonating apparatus or perforating gun is kept in a non-firing or unarmed condition when lowered into the well to enhance safety. The present invention is also readily adapted to be used with equipment presently utilized in the detonating process, such as pipe connected to an explosive carrier and a gamma ray neutron tool, which is used in determining a more precise position of the detonating apparatus in the well.

Additional advantages of the present invention will become apparent from the following discussion when taken in conjunction with the accompanying drawings.

DESCRIPTION OF THE PREFERRED EMBODIMENTS

Figure 1:
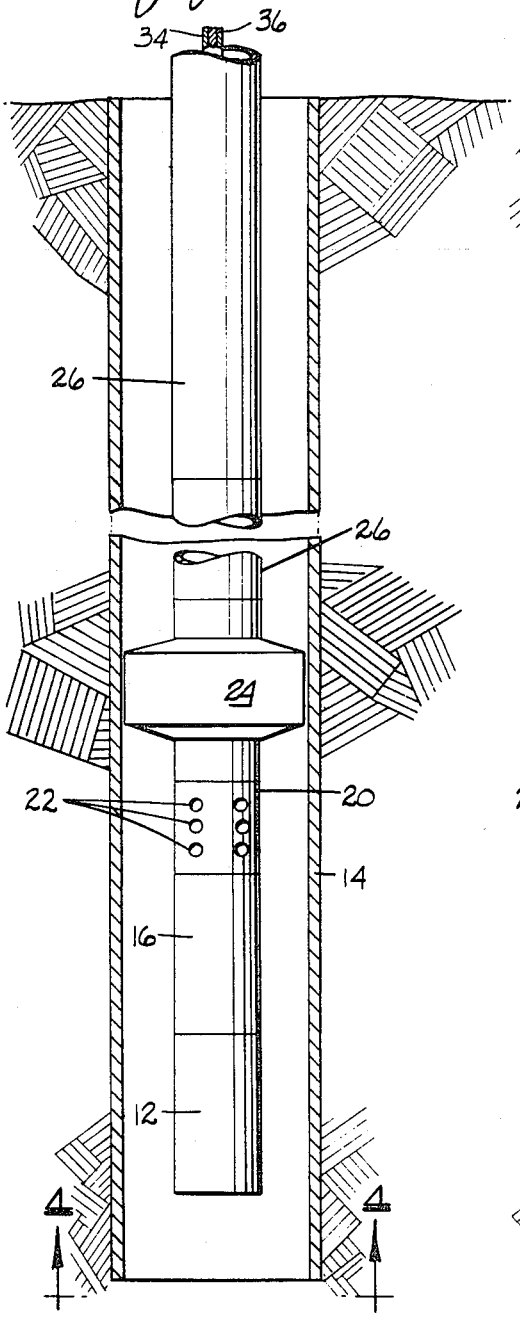
FIG. 1 is a side elevation with parts in cross-section of the invention.
Figure 2:
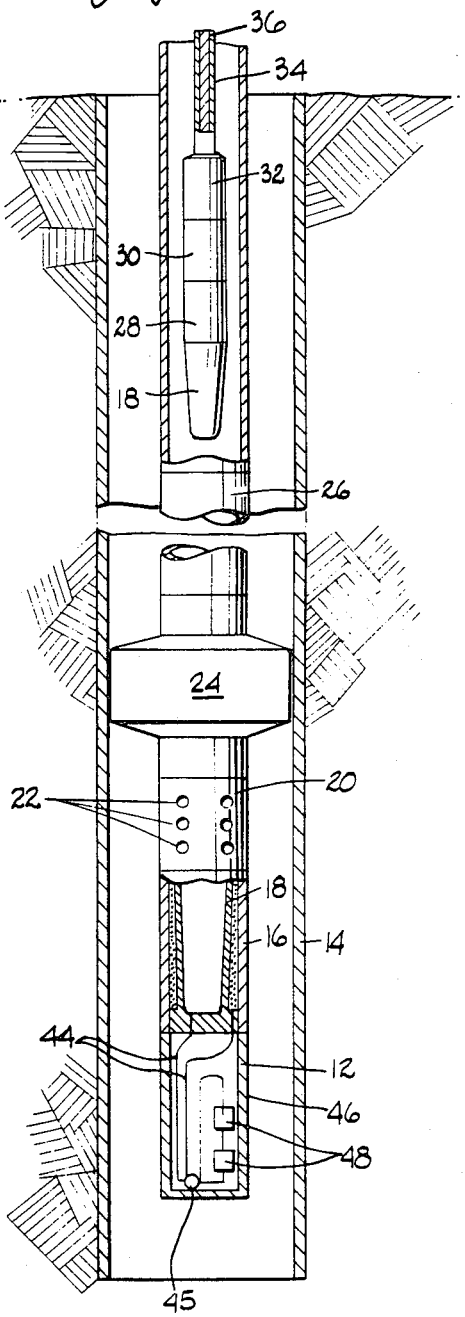
FIG. 2 is a side elevation with parts in cross-section of the invention just prior to complete assembly.

In accordance with the present invention, an apparatus 10 is provided for use in detonating explosives housed in a gun or carrier 12 after the gun 12 is positioned in a well casing 14 located in a well. With reference to FIGS. 1 and 2, the apparatus 10 comprises a female coupling member 16 and a male coupling member 18. The female coupling member 16 is connected at one end by conventional means to the gun 12. At the opposite end the female coupling member 16 is connected to a sleeve 20 having perforations 22. The sleeve 20 is connected to a packer 24, which is an expandable device for providing a seal between portions of the well above and below the sleeve 20. The packer 24 is joined to pieces of pipe 26, which extend from the well surface. The pipe 26, packer 24, sleeve 20, female coupling member 16, and gun 12 are supported in the well by conventional slips (not shown).

The male coupling member 18 has a free end and is connected at its opposite end to a gamma ray neutron tool 28. The tool 28 is a common device used to detect background earth formations for use in determining the position of the male coupling member 18 as it is moved in the well. The tool 28 is connected to a collar locater 30. The collar locater 30 is also a conventional instrument which is able to detect differences in electromagnetic flux. Such a difference is detected at the joint of each pipe section. The collar locater 30 is joined to a common cable head 32. The cable head 32 receives and is attached to a steel wire 34. The steel wire runs to the well surface and the movement thereof is controlled by a winch (not shown), used in adjusting the vertical position of the male coupling member 18 in the well. Steel wire 34 includes an outer shell of steel which surrounds an insulated center conductor wire 36.

Figure 3:
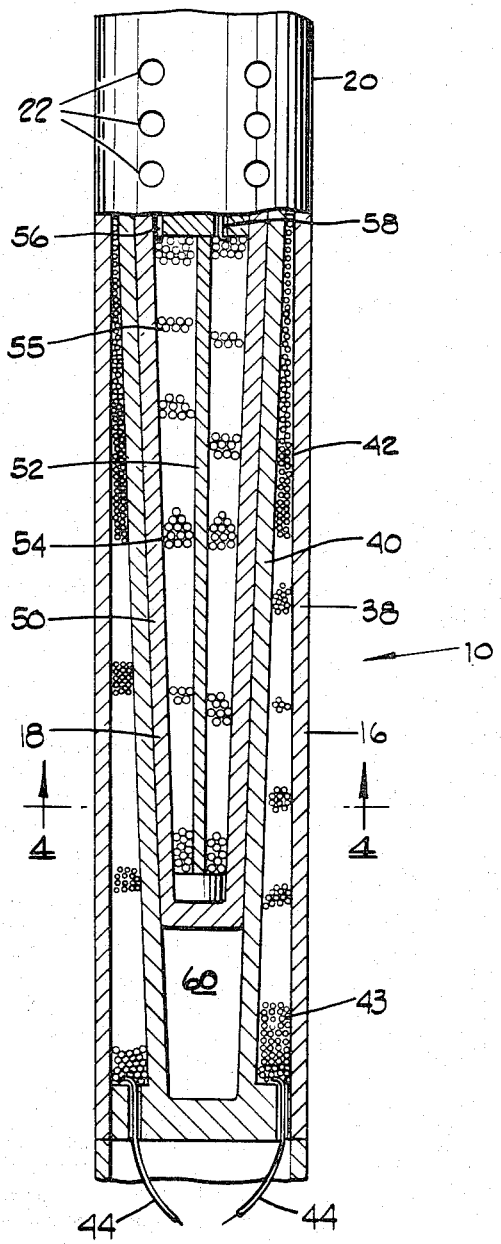
FIG. 3 is a side elevation with parts in cross-section of the invention fully assembled.
Figure 4:
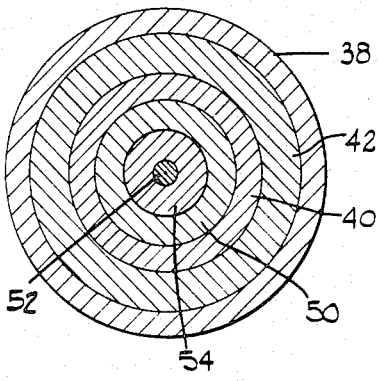
FIG. 4 is a view in cross-section taken on the lines 4—4 of FIG. 3.

With reference also to FIGS. 3 and 4, more details of the female coupling member 16 and male coupling member 18 are provided. The female coupling member 16 includes a hollow female housing 38 and a frustum-shaped hollow coil form or body 40. Wrapped around the outer surface of the coil form 40 is conductor wire to form a secondary coil 42. As illustrated in FIG. 3, the secondary coil 42 has more windings 43 adjacent the bottom of the coil form 40 than at the top of the coil form 40. The inner surface of the secondary coil 42 is generally frustum-shaped and the outer surface thereof is generally cylindrical-shaped. The coil form 40 with conductor wire 42 positioned therearound is located within the hollow female housing 38. Two leads of conductor wire 44 extend out of the female coupling member 16 and are connected to a blasting cap 45 located in the carrier 12. The blasting cap 45 is joined to the primary cord 46 to which explosive charges 48 are connected.

The male coupling member 18 includes a frustum-shaped hollow male housing 50 and a coil form 52. Conductor wire is wrapped around the outer surface of the coil form 52 to form a primary coil 54. As illustrated in FIG. 3, the primary coil 54 has more windings 55 adjacent to the top of the coil form 52 than at the bottom of the coil form 52. The inner surface of the primary coil 54 is generally cylindrical-shaped and the outer surface thereof is generally frustum-shaped. The coil form 52 with conductor wire 54 is positioned within the hollow male housing 50. One lead 56 of the conductor wire 54 is grounded while the second lead 58 is connected to the center conductor 36 of the steel wire 34. The center conductor 36 is electrically connected to a source of electrical energy at the well surface.

As illustrated in FIG. 3, the female coupling member 16 and the male coupling member 18 are shaped so that a cavity 60 is formed when they are in the assembled condition. This provides a receptacle for any foreign matter which might otherwise interfere with the proper relative locations of the female coupling member 16 and male coupling member 18 when in the assembled condition.

The female housing 38, the female coil form 40, the male housing 50, and the male coil form 52 are each made of a non-magnetic, non-ferrous material while conductor wire for the primary coil 42 and the secondary coil 54 is typically conventional transformer wire.

In operation, the gun 12 is loaded with the blasting cap 45 and explosive charges 48. The two leads 44 of the conductor wire 42 are electrically connected to the blasting cap 45. The female coupling member 16 is fastened to the gun 12. The sleeve 20 and packer 24 are joined to the female coupling member 16. Sections of pipe 26 are continuously added to the packer 24 to lower the gun 12 and female coupling member 16 into the well. An operator is able to determine the depth thereof during the lowering process by monitoring the number of pipe section and the length of each.

After the female coupling member 16 is positioned at least near the desired location in the well, the male coupling member 18 can be lowered into the well. In the embodiment just described, the gamma ray neutron tool 28 is fastened to an end of the male coupling member 18 and the collar locator 30 is joined to the gamma ray neutron tool 28. The cable head 32 is connected to the collar locator 30 and the center conductor 36 is connected to the primary coil 54. The male coupling member 18 is then lowered into the well using the steel wire 34. The position of the male coupling member 18 in the well can be determined by monitoring the length of steel wire 34 being used. The position of the male coupling member 18 can also be found by use of the collar locater 30 which provides an indication to an operator as to the number of joints of pipe 26 which the collar locater 30 passes.

Continuing movement of the male coupling member 18 is accompanied also by the gamma ray neutron tool 28 providing background information to the operator regarding the position of the male coupling member 18. By means of the tool 28, the operator is able to position the male coupling member 18 at the desired location in the well at which a hole is to be formed in the well casing 14. In the event that the female coupling member 16 is lower than the desired location, the operator controls movement of the pipe 26 in an upward direction until the hollow female coil form 40 matingly receives or engages the male housing 50 at the desired location. In the event that the female coupling member 16 is higher than the desired location, the operator controls the movement of the pipe 26 downwardly so that the gun 12 is close to the desired location and the male coupling member 18 is also moved to check whether the desired location is achieved using the gamma ray neutron tool 28. Again, at the desired location, the female coupling member 16 and male coupling member 18 are in mating engagement. The operator is able to determine that the female coupling member 16 and male coupling member 18 are in mating engagement by the reduction or loss in tension on the steel wire 34 when the male coupling member 18 is supported by the female coupling member 16.

As can be understood, the male coupling member 18 is, in typical operation, not lowered into the bore of the pipe 26 using the steel wire 34 until after no further sections of pipe 26 are to be added to the female coupling member 16 so that the female coupling member 16 is near the desired location. Otherwise, the operator would have difficulty in adding pipe 26 since the steel wire 34 would act to obstruct the process of connecting succeeding sections of pipe 26 together.

It is also understood that, although the above-described embodiment is directed to a female coupling member 16 connected to the gun 12 and a male coupling member 18 connected to the steel wire 34, an embodiment could be provided wherein the male coupling member 18 is connected to the gun 12 while the female coupling member 16 is joined to the steel wire 34.

It is further appreciated that the gamma ray neutron tool 28 and collar locater 30 need not be connected to the male coupling member 18 and lowered into the well together. Instead, the tool 28 could be used to find a desired location and thereafter the male coupling member 18 is positioned at that location.

After the female coupling member 16 and male coupling member 18 are positioned at the desired location, the explosive charges 48 can be detonated. The source of electrical energy is activated to supply AC or pulsating current to the center conductor 36 of the steel wire 34. The current is carried by the center conductor 36 to the primary coil 54. The current is inductively coupled from the primary coil 54 to the secondary coil 42. Since the secondary coil 42 is electrically connected to the blasting cap 45, the AC or pulsating current is carried thereto and triggers the blasting cap 45. The blasting cap 45 being triggered results in a detonation of the explosives 48 causing a hole to be formed in the gun 12 and a hole or perforation to be formed in the well casing 14 along the desired zone. The detonation of the explosives inflicts no damage on either the first or second coupling members so they can be used again. The expected oil flows through the well casing 14 hole into the bore of the well casing 14. Because the oil cannot bypass the sealing packer 24, it flows through the perforations 22 formed in the sleeve 20 and moves up the pipe 26 to the well surface.

The male coupling member 18 can be disengaged from the female coupling member 16 and raised out of the bore of the pipe 26. Similarly, when the pipe 26 is removed from the well, the female coupling member 16 is raised so that it can be used again.

Although the present invention has been described with reference to certain embodiments, it is readily understood that variations and modifications can be effected within the spirit of the scope of this invention.

What is claimed is:

1. An apparatus for detonating an explosive using a triggering device housed in a carrier located in a bore hole, comprising:

a first coupling member, said first coupling member being made of a non-ferromagnetic material, said first coupling member being free of shielding that protects against high frequency electrical fields;

secondary conducting means being coiled about portions of said first coupling member;

first electrical connecting means associated with said first coupling member, said first electrical connecting means adapted to be connected to the carrier containing the explosive, said first electrical connecting means electrically connecting said secondary conducting means to the triggering device and the explosive located in the carrier;

a second coupling member, said second coupling member being made of a non-ferromagnetic material, said second coupling member being free of shielding that protects against high frequency electrical fields;

primary conducting means being coiled about portions of said second coupling member, both said first coupling member and said second coupling member being apart from, but removably joined to, the carrier housing the explosive and the triggering device, said primary conducting means being located inwardly relative to said secondary conducting means, said inwardly disposed primary conducting means used in inductively exciting said secondary conducting means; and second electrical connecting means associated with said second coupling member, said second electrical connecting means adapted to be connected to means used in moving said second coupling member, said second electrical connecting means electrically connecting said primary conducting means and a source of electrical energy, said second electrical connecting means extending from the source of power down the bore hole to said primary conducting means;

said first coupling member and said second coupling member being separately positioned in the bore hole and being matingly engageable, said primary conducting means and said secondary conducting means providing a path for electrical energy from the source of electrical energy for detonating the explosive wherein electrical energy is supplied from the source of electrical energy to said primary conducting means using said second electrical connecting means, said primary conducting means inductively coupling electrical energy to said secondary conducting means for detonating the explosive using the triggering device after and first coupling member and said second coupling member are matingly engaged.

2. An apparatus as claimed in claim 1, wherein:

said first coupling member includes a hollow coil form and a female housing, said coil form having said first conducting means located around a surface thereof, said coil form being positioned in said female housing.

3. An apparatus, as claimed in claim 2, wherein:

said first conducting means is located between said coil form and said female housing of said first coupling member.

4. An apparatus, as claimed in claim 2, wherein:

said second coupling member includes a male housing and a coil form, said coil form having said second conducting means located around a surface thereof, said male housing being matingly received into said hollow coil form of said first coupling member.

5. An apparatus, as claimed in claim 4, wherein:

said second conducting means is located between said coil form and said male housing of said second coupling member.

6. An apparatus, as claimed in claim 4, wherein:

said coil form of said first coupling member and said male housing are reversely frustum-shaped so that the narrowest portion of said male housing enters into the widest portion of said hollow coil form of said first coupling member.

7. An apparatus, as claimed in claim 6, wherein said first conducting means comprises:

transformer wire wound around said hollow coil form of said first coupling member to form a plurality of windings therearound;

the inner windings form a generally frustum-shaped surface similar to the frustum-shape of said hollow coil form of said first coupling member; and the outer windings form a generally cylindrical-shaped surface so that the number of windings increase from one end of said first coupling member to the other end thereof.

8. An apparatus, as claimed in claim 6, wherein said second conducting means comprises:

transformer wire wound around said coil form of said second coupling member to form a plurality of windings therearound;

the inner windings form a generally cylindrical-shaped surface; and the outer windings form a general frustum-shaped surface similar to the frustum shape of said male housing so that the number of windings decreased from one end of said second coupling to the other end.

9. Apparatus, as claimed in claim 6, wherein said first conducting means comprises:

transformer wire wound around said hollow coil form of said first coupling member to form a plurality of windings therearound;

the inner windings form a generally frustum-shaped surface similar to the frustum-shape of said hollow coil form of said first coupling member; and the outer windings form a generally cylindrical-shaped surface so that the number of windings increase from one end of said first coupling member to the other end thereof; and said second conducting means comprises:

transformer wire wound around said coil form of said second coupling member to form a plurality of windings therearound;

the inner windings form a generally cylindrical-shaped surface; and the outer windings form a general frustum-shaped surface similar to the frustum shape of said male housing so that the number of windings decreased from one end of said second coupling to the other end; and the end of said second coupling means containing the greatest number of windings being located opposite the end of said first coupling means having the fewest number of windings.

10. An apparatus, as claimed in claim 1, wherein:

said first and second conducting means include transformer wire.

11. A method for detonating an explosive using a triggering device housed in a carrier positioned in a bore hole, comprising:

forming a first coupling member made of a non-ferromagnetic material;

coiling a secondary conducting means about portions of said first coupling member;

providing a carrier housing at least one explosive and a triggering device;

joining said first coupling member and said carrier together;

positioning said first coupling member and said carrier in a casing located in a bore hole;

forming a second coupling member made of a non-ferromagnetic material;

coiling a primary conducting means about portions of said second coupling member;

positioning said second coupling member into the bore hole;

matingly joining said first coupling member and said second coupling member wherein said primary conducting means is located inwardly relative to said secondary conducting means;

supplying electrical energy to a conductor wire associated with said primary conducting means;

inductively coupling said electrical energy to said secondary conducting means; and causing an explosion using said inductively coupled electrical energy in order to form a hole at the desired location in the bore hole.

12. A method, as claimed in claim 11, and further comprising:

proving a coil form for said first coupling member;

winding transformer wire around said coil form to form said secondary conducting means and to form a plurality of windings about said coil form; and gradually increasing the number of windings from one end of said coil form to the other end thereof so that the inner surface of said plurality of windings is generally frustum-shaped and the outer surface of said plurality of windings is generally cylindrical-shaped; and providing a coil form for said second coupling member;

winding transformer wire around said coil form to form said primary conducting means and to form a plurality of windings about said coil form;

gradually increasing the number of windings from one end of said coil form to the other end thereof so that the inner surface of said plurality of windings is generally cylindrical-shaped and the outer surface of said plurality of windings is generally frustum-shaped; and inserting said second coupling member into said first coupling member so that the end of said second coupling member having the greatest number of windings is opposite the end of said first coupling member having the fewest number of windings.

* * * * *

UNITED STATES PATENT AND TRADEMARK OFFICE

CERTIFICATE OF CORRECTION

PATENT NO. : 4,544,035

DATED : October 1, 1985

INVENTOR(S) : Charles V. Voss

It is certified that error appears in the above—identified patent and that said Letters Patent is hereby corrected as shown below:

Column 1, line 59, delete "corect" and substitute therefor --correct--.

Column 2, line 48, delete "Synder" and substitute therefor --Snyder--.

Column 5, line 19, delete "42" and substitute therefor --54--.

Column 5, line 20, delete "54" and substitute therefor --42--.

Column 7, line 48, delete "and" and substitute therefor --said--.

Column 10, line 1, delete "proving" and substitute therefor --providing--.

Signed and Sealed this

*Third* Day of *December 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,544,035

DATED : October 1, 1985

INVENTOR(S) : Charles V. Voss

It is certified that error appears in the above—identified patent and that said Letters Patent is hereby corrected as shown below:

Column 1, line 50, delete the second occurrence of "as".

Column 5, line 37, delete "locator" and substitute therefor --locater--.

Column 5, line 39, delete "locator" and substitute therefor --locater--.

Signed and Sealed this

*Twenty-fifth* Day of *February 1986*

[SEAL]

*Attest:*

DONALD J. QUIGG

*Attesting Officer*

*Commissioner of Patents and Trademarks*